United States Patent [19]

Johansson

[11] 3,980,035

[45] Sept. 14, 1976

[54] ATTITUDE CONTROL DEVICES FOR STERN DRIVE POWER BOATS

[76] Inventor: Sten E. Johansson, 5711 S. 152nd Place, No. 120, Seattle, Wash. 98188

[22] Filed: Dec. 23, 1974

[21] Appl. No.: 535,719

[52] U.S. Cl. ..... 114/66.5 H; 115/17; 115/34 R

[51] Int. Cl.[2] ..... B63B 1/26

[58] Field of Search ..... 114/66.5 R, 66.5 H, 114/66.5 P, 66.5 S, 126, 162, 16 A; 115/34 R, 17, 18 A, 18 B, 41 R, 42, 6.1, 70

[56] References Cited

UNITED STATES PATENTS

| | | | |
|---|---|---|---|
| 1,529,036 | 3/1925 | Richey | 114/66.5 R |
| 2,099,492 | 11/1937 | Luders | 114/66.5 R |
| 2,705,468 | 4/1955 | Dix | 114/66.5 H |
| 3,120,829 | 2/1964 | Chew et al. | 114/162 |
| 3,199,483 | 8/1965 | Ellzey | 114/66.5 H |
| 3,358,635 | 12/1967 | McRee | 115/6.1 |
| 3,433,195 | 3/1969 | Poole | 114/66.5 H |
| 3,618,551 | 11/1971 | Deslierres | 114/16 A |
| 3,804,048 | 4/1974 | Cline | 114/66.5 H |

FOREIGN PATENTS OR APPLICATIONS

| | | | |
|---|---|---|---|
| 6,805,351 | 10/1969 | Netherlands | 115/42 |

*Primary Examiner*—Duane A. Reger
*Assistant Examiner*—Charles E. Frankfort
*Attorney, Agent, or Firm*—Graybeal, Barnard, Uhlir & Hughes

[57] ABSTRACT

A laterally extending trim vane is mounted for rotation about a horizontal axis on a submerged portion of a stern-drive propulsion unit housing, substantially within the slipstream of the propeller.

The trim vane is mounted on structure which depends downwardly from a rearward part of a horizontally elongated intermediate portion of the housing. The aft location of the trim vane provides a relatively large moment arm for the vertical trim force. Hence, for a given moment, the aft position requires less force. Also, the propeller slipstream velocity relative to the vane is considerably higher than the speed of the boat. The aft location of the vane, providing the longer moment arm, and the utilization of slipstream water, providing a relatively high velocity of motive fluid, make it possible to make the control surface of the vane quite small.

11 Claims, 17 Drawing Figures

10
12
14
16
18
20
22
24
46
48
50
52
8
8

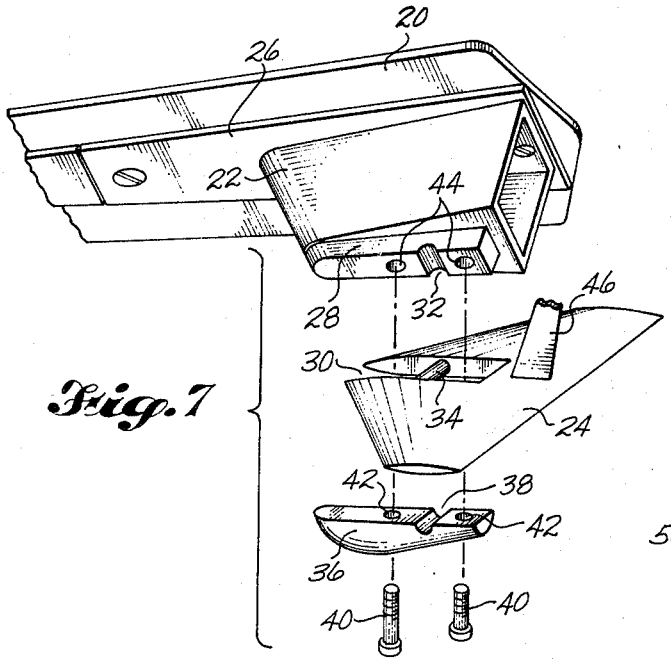
Fig. 7
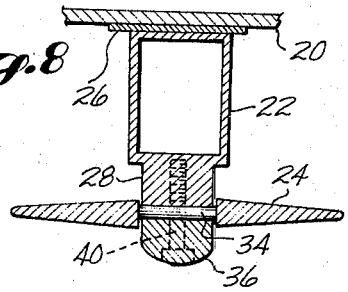
Fig. 8
Fig. 9
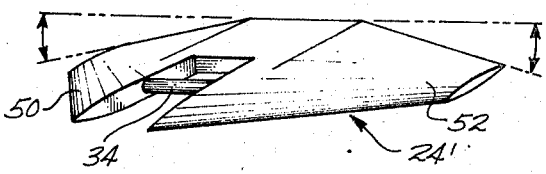
Fig. 9A
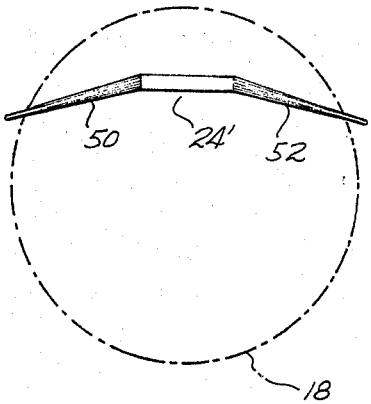
Fig. 10
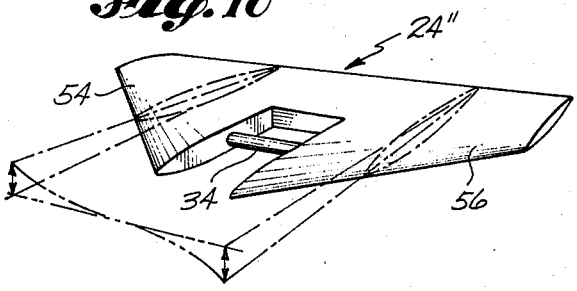
Fig. 10A
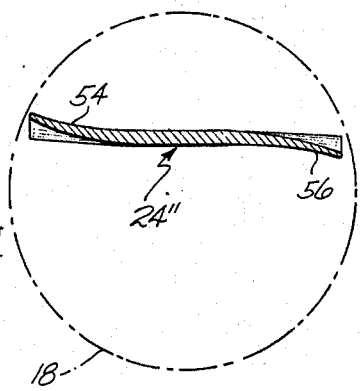

Fig. 13
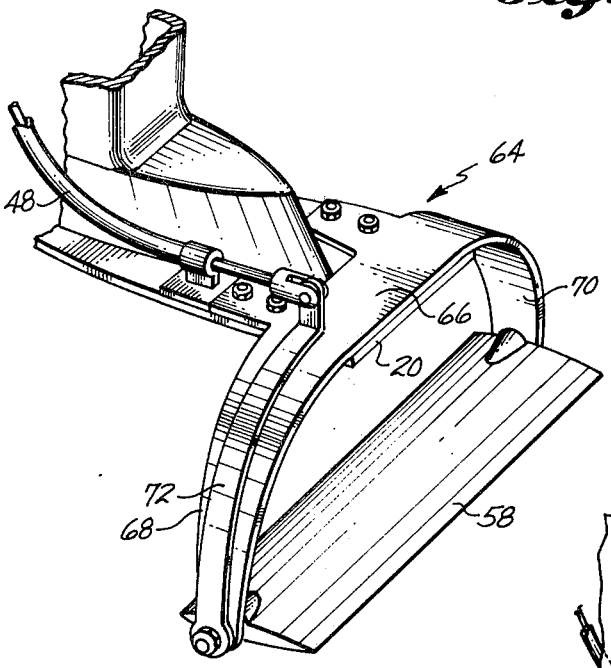
Fig. 11
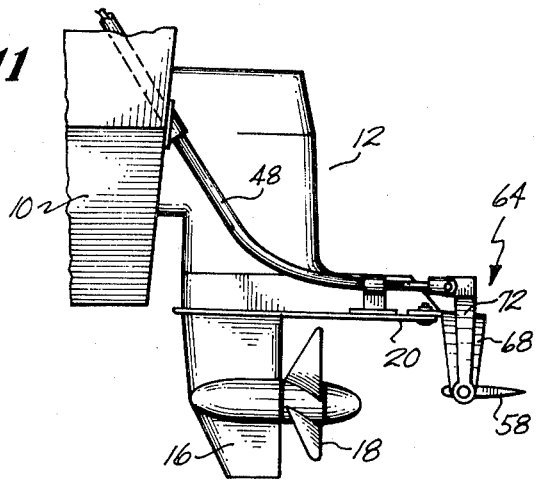
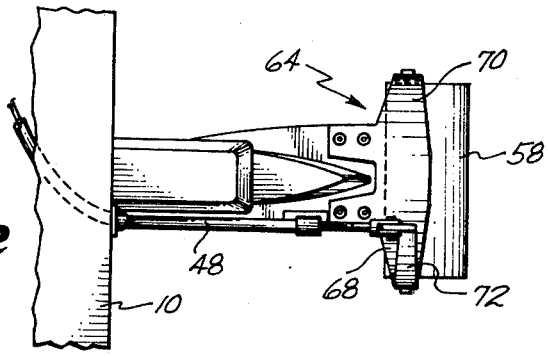
Fig. 12
Fig. 14
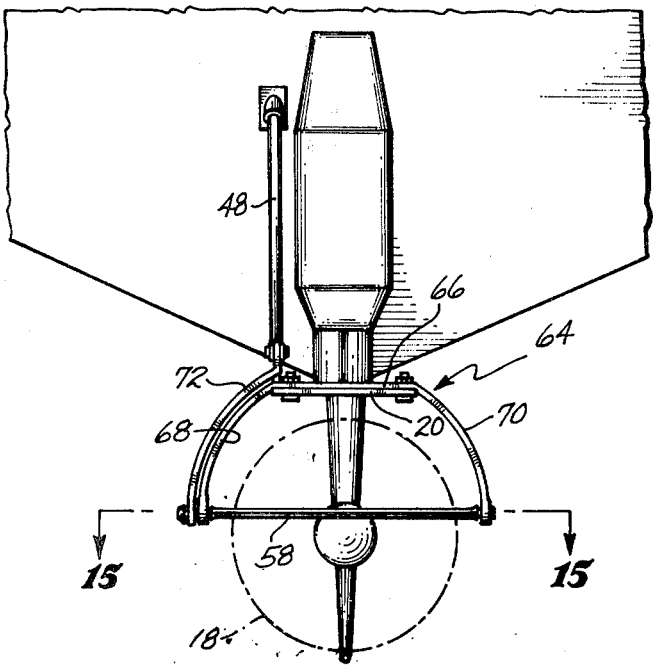
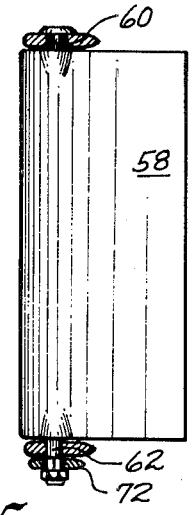
Fig. 15

ATTITUDE CONTROL DEVICES FOR STERN DRIVE POWER BOATS

BACKGROUND OF THE INVENTION

1. Field of the Invention

This invention relates to trimming devices, and particularly to trimming devices mounted on stern drive motors for power boats, such as inboard-outboard and outboard motors, substantially within the slipstream of the propeller.

2. Description of the Prior Art

It is commonly known that the attitude angle of a power boat is important for its performance. If the bow is riding too high or too low, the power required is greater than if the attitude had been somewhere inbetween. Hence, there exists an attitude angle that gives the best cruise performance and economy for each speed. There are on the market today several devices to accomplish attitude control.

It is known to control the attitude of boats by use of trim tabs mounted onto the stern of the boat. Examples of patented trim tabs are disclosed by U.S. Pat. No. 3,001,499, granted Sept. 26, 1961, to Joseph H. Jacobs and Marcellus L. Jacobs; U.S. Pat. No. 3,046,928, granted July 31, 1962, to John F. Sherrill; U.S. Pat. No. 3,062,167, granted Nov. 6, 1962, to Charles H. Bennett; U.S. Pat. No. 3,177,837, granted Apr. 13, 1965, to John F. Sherrill; U.S. Pat. No. 3,298,344, granted Jan. 17, 1967, to Robert E. Yunker and John T. Southern; and U.S. Pat. No. 3,463,109, granted Aug. 26, 1969, to Howard E. Weiler.

An example of apparatus for vertically trimming an outdrive type power boat by adjusting the outdrive to change the angle of the propeller thrust vector relative to boat is disclosed in U.S. Pat. No. 3,842,789, granted Oct. 22, 1974 to Karl A. Bergstedt. The trim control of some boats equipped with stern drives or outboard motors is performed by changing the direction of the propeller thrust vector in a vertical plane. This means that the control device has to overcome the reaction force created by the propeller thrust. In all known cases the control is assisted by electrical or hydraulic power.

Known trimming apparatuses in the nature of one or more horizontal vanes positioned closely adjacent a propeller and adjustable in angle about a horizontal axis are disclosed by the folliwing U.S. Pat. Nos. 1,529,036, granted Mar. 10, 1925 to Clarence F. Richey; 2,099,492, granted Nov. 16, 1937, to Alfred E. Luders; No. 2,705,468, granted Apr. 5, 1955, to Sidney Dix; 3,120,829, granted Feb. 11, 1964, to Wilson W. Chew and Willis G. Stewart; 3,199,483, granted Aug. 10, 1965, to Floyd P. Ellzey; 3,433,195, granted Mar. 18, 1969, to Charles W. Poole and 3,804,048, granted Apr. 16, 1974, to David J. Cline.

SUMMARY OF THE INVENTION

According to an aspect of the invention a trimming wing or vane is mounted onto the lower submerged portion of the housing of an outdrive or outboard propulsion unit, substantially within the slipstream of the propeller.

It is an object of the present invention to provide a trim vane positioned aft of the propeller, positioned to provide good hydrodynamic efficiency. With this arrangement good control can be achieved even if the boat is traveling at low speed. The application provides a longer moment arm for the vertical trim force.

Hence, for a given moment, the aft position requires less force and the control surface size can be kept at a minimum. Also, the propeller slipstream velocity relative to the vane is considerably higher than the speed of the boat. This higher velocity is used for creating the trimming force.

Another object of the invention is to provide such an aft located trim vane which has a hinge line located in the vicinity of the hydrodynamic center of the vane, so that the force required to rotate the trim vane is very small.

A further object of the invention is to make use of the flow energy in the propeller slipstream in order to improve the efficiency of the trimming device, especially at lower speeds.

Yet another object of the invention is to utilize the flow energy slipstream to minimize the size of the vane.

Yet another object of the invention is to locate the vane as far aft as practicable in order to obtain a maximum trimming moment arm and hence a minimum trimming force for a given trimming moment.

A further object of the invention is to provide a trim vane located aft of a propeller, substantially in the slipstream, and which is shaped to be substantially evenly loaded when contacted by the spiraling slipstream of the propeller.

The invention encompasses several styles of trim vane, as will be apparent from the following description when read with reference to the accompanying drawing.

BRIEF DESCRIPTION OF THE DRAWING

In the drawing like reference numerals denote corresponding parts throughout the several view, and:

FIG. 7 is an exploded pictorial view of the trim vane and its mounting structure;

FIG. 8 is a transverse sectional view taken substantially along line 8—8 of FIG. 4;

FIG. 9 is a pictorial view of a modified form of trim vane, configured to correct directional or sideways trim as well as vertical trim;

FIG. 9A is a rear view of the trim vane of FIG. 9, showing its position relative to the propeller disc;

FIG. 10 is a view like FIG. 9, but of another form of trim vane, configured to adjust to the spiralling flow of the slipstream;

FIG. 10A is a view like FIG. 9A, but showing the trim vane of FIG. 10, in section;

FIG. 11 is a view like FIG. 2, but of a rear mounted trim vane with modified mounting and control structures;

FIG. 12 is a view like FIG. 4, but of the embodiment shown by FIG. 11;

FIG. 13 is an assembled pictorial view of the trim vane portion of the outdrive assembly shown by FIGS. 11 and 12;

FIG. 14 is an enlarged scale rear elevational view of the stern drive assembly shown by FIGS. 11 – 13; and FIG. 15 is a cross-sectional view taken substantially along line 15—15 of FIG. 14, including a top plan view of the trim vane.

DESCRIPTION OF THE PREFERRED EMBODIMENTS

Figures 1, 2, 3, 4, 5, 6:
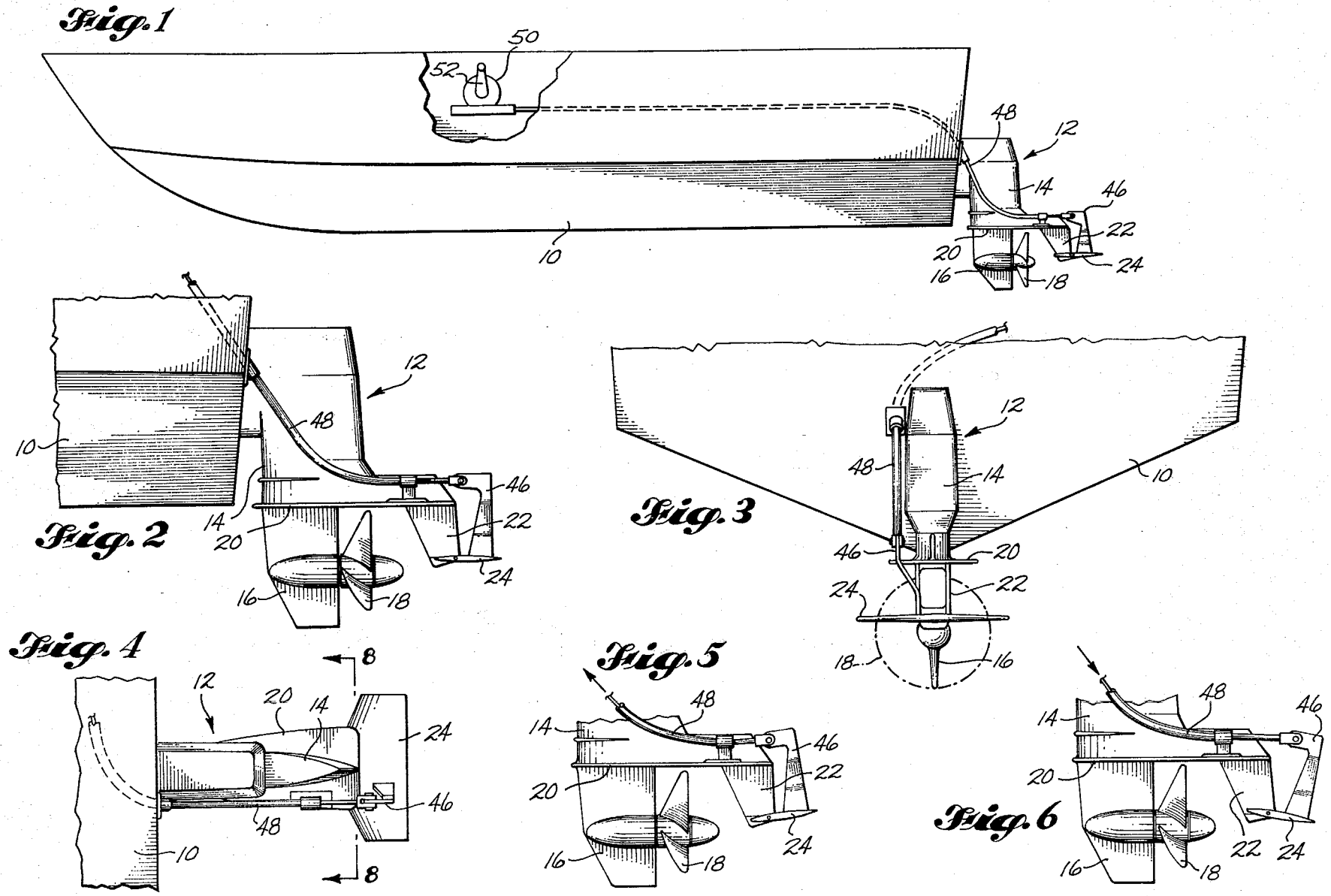
FIG. 1 is a side elevational view of a power boat powered by a stern drive assembly equipped with a trim vane constructed in accordance with the present invention.
FIG. 2 is an enlarged scale side elevational view of the stern drive and the trim vane in FIG. 1.
FIG. 3 is an elevational view looking toward the stern of the power boat in FIGS. 1 and 2.
FIG. 4 is a top plan view of the rear portion of the power boat and stern drive in FIGS. 1 – 3.
FIG. 5 is a fragmentary view of a lower portion of the assembly of FIG. 2, but showing the trim vane rotated forwardly.
FIG. 6 is a view like FIG. 5, but showing the trim vane rotated rearwardly.

The power boat 10 shown by FIG. 1 includes a stern drive assembly 12 which may be conventional except for the trimming mechanism of this invention.

The stern drive assembly 12 includes a drive shaft housing 14 having a gear box 16 at its lower end. The gear box 16 rotatably supports a propeller shaft onto which a propeller 18 is mounted. In accordance with conventional design, the housing 14 includes a cavitation plate 20 positioned over the propeller 18.

It is a conventional practice to exhaust the gases from the inboard internal combustion engine (not shown) which powers the outdrive assembly through a tubular strut 22 which depends below the cavitation plate 20 rearwardly of the propeller 18. In accordance with one aspect of the present invention the exhaust duct strut 22 is adapted for mounting a trim vane or wing 24.

Referring to FIG. 7, the strut 22 is shown to be a part of a mounting plate 26 which is bolted or otherwise secured to the cavitation plate 20. The lower portion 28 of strut 22 is loosely received within a recess 30 formed within the forward central portion of trim vane 24. End portion 28 is formed to include a transverse groove 32 which receives a transverse shaft 34 on trim vane 24, spanning across the recess 30. A mounting cap 36 having a similar groove 38 is attached to the strut below the axle 34. The cap 36 is detachably connected to the strut 22, such as by mounting bolts 40. The bolts 40 may extend through openings 42 formed in cap 36 and thread into tapped openings 44 formed in the lower portion 28 of strut 22. The grooves 32, 38 serve to journal the shaft 34 for rotation.

In preferred form, the shaft 34 is located at about the hydrodynamic center of trim vane 24. This location of the pivotal axis is preferred because it results in a small unbalanced moment on vane 24 and a quite small force being required for rotating the trim vane 24.

By way of typical and therefore non-limitive example, the trim vane 24 may include an upstanding control lever 46 (FIGS. 1 – 7) connected to vane 24 rearwardly of shaft 34. The upper end of lever 46 is connected to a push-pull control cable 48 which extends forwardly from lever 46 to a control device 50 within the power boat 10. Control device 50 may comprise a control lever 52 which when pushed forwardly pushes the control cable 48 rearwardly and when pulled rearwardly pulls the control cable 48 forwardly. As diagrammed in FIGS. 5 and 6, forward movement of control cable 48 swings the aft end of the trim vane 24 upwardly and rearward movement of control cable 48 swings the aft end of trim vane 24 downwardly.

The size, shape and mounting arrangement of the trim vane may vary substantially. In FIGS. 1 – 8, the vane 24 is shown to include a generally straight trailing edge, a rearwardly swept leading edge, and a shallow teardrop shaped cross section which progressively decreases in size outwardly from the support strut 22.

According to one aspect of the invention, the trim vane is shaped to be substantially evenly loaded when contacted by the spiraling slipstream of the propeller. One such trim vane, designated 24′ in FIG. 9, has opposite end portions 50, 52 which slope downwardly as they extend endwise outwardly. This provides a dihedral lower surface shape of the vane 24′ (FIG. 9A) which reduces the adverse influence of the spiraling slipstream. In this manner side forces tending to turn the boat sideways can at least be reduced to an acceptable level. This object may also be reached by canting the opposite end portions of the trim vane in the manner illustrated by FIG. 10 and FIG. 10A. The end portion of the trim vane on the starboard side of the boat progressively increases in positive angle of incidence as it extends endwise outwardly and the end portion on the port side progressively increases in negative angle of incidence as it extends outwardly to provide a symmetrical load of the vane.

FIGS. 11 – 15 show another form of trim vane 58. Vane 58 may have a substantially constant cross-sectional shape throughout its length. It is shown to include trunnions 60, 62 at its ends which are journaled for rotation between depending end portions of a mounting bracket 64. As best shown by FIGS. 13 and 14, the mounting bracket 64 includes a center section 66 which is bolted to the cavitation plate 20 and a pair of depending side sections 68, 70 which may be curved in the manner illustrated. Trim vane 58 may be rotated by control means including a lever 72 which is secured at its lower end to trunnion 62 and extends upwardly therefrom contiguous bracket section 68. The push-pull type control cable 48 is attached to the upper portion of lever 72.

According to the invention, the trim vane can comprise a fixed forward portion or member and a movable rear portion or member, viz. an arrangement similar to an airplane wing and its aileron.

The purpose of the movable control portion of the trim vane is to create a vertical force that is transferred to the boat creating a moment around a centroid somewhere between bow and stern. This force is dependent upon the angle of attack that the control portion forms with the water flow direction. The force is proportional to the speed of the water flow squared (or proportional to the hydrodynamic pressure). The force is also proportional to the size of the control portion of the vane.

The aft position of the trim vane provides good hydrodynamic efficiency. The control surface size can be kept at a minimum. Good control can be achieved even if the boat is traveling at low speed. The aft location provides a longer moment arm for the vertical trim force. Hence, for a given moment, the aft position requires less force. Also, the propeller slipstream velocity relative to the vane is considerably higher than the speed of the boat. This higher velocity is used for creating the trimming force.

A trim vane with a symmetrical hydrofoil possesses a transversal axis about which the moment of the hydrodynamic force is a zero. This axis is known from the "wing theory" to be located at the location of the aerodynamic center. The hinge moment about this axis is for practical purposes considered independent of angle of attack. According to an aspect of the invention, the hinge line of the trim vane is located in the vicinity of the hydrodynamic center, so that the force required to rotate the trim vane is very small.

According to another aspect of the invention, the trim vane also serves as a stabilizer with the purpose of reducing or eliminating pitch oscillations of the boat at planing speeds.

What is claimed is:

1. In combination, a marine sterndrive propulsion unit adapted for attachment to a transom located mount comprising a generally vertically elongated housing which during use is positioned immediately rearwardly of the transom, said housing having a lower portion which during use is submerged, said housing further including a rearwardly projecting generally horizontally elongated mid-portion, a propeller supported by said lower portion, and adjustable trim tab means comprising:

a laterally extending vane member;

support strut means depending from a rear part of the horizontally elongated mid-portion of said housing, said support means mounting said vane member onto said housing and positioning said vane at a location below the water line, aft of the propeller and substantially within the slipstream of the propeller for rotation about a horizontal axis, with opposite portions of said vane member projecting outwardly from opposite sides of said depending support strut means in wing-like fashion; and control means for rotating said vane in position about said horizontal axis, to change the ange of attack on said vane member.

2. The combination of claim 1, wherein the vane member is shaped to be substantially evenly loaded when contacted by the spiraling slipstream of the propeller.

3. The combination of claim 2, wherein the vane member has opposite end portions which slope downwardly as they extend endwise outwardly, providing the vane with a lower surface of dihedral shape.

4. The combination of claim 2, wherein the opposite end portions of the vane member are oppositely canted such that on one side the vane member progressively increases in positive angle of incidence as it extends endwise outwardly and on the other side it progressively increases in negative angle of incidence as it extends endwise outwardly.

5. The combination of claim 1, wherein said horizontal axis is located between the front and rear edges of the vane member.

6. The combination of claim 5, wherein said horizontal axis is substantially on the hydrodynamic center of the vane member.

7. The combination of claim 1, wherein the means mounting said vane member onto said housing for rotation about said horizontal axis further includes an axle secured to said vane member and means on said housing carrying a bearing for said axle.

8. The combination of claim 7, wherein the bearing for said axle comprises a first member on said housing which includes a transverse groove for receiving the axle and a second member for retaining said axle within said groove which is removably secured to said first member.

9. The combination of claim 1, wherein said control means comprises a lever extending upwardly from the vane member and a push-pull type control member connected to the lever and leading forwardly therefrom to an operator's station.

10. In combination, a marine stern-drive propulsion unit adapted for attachment to a transom located mount comprising a generally vertically elongated housing which during use is positioned immediately rearwardly of the transom, said housing having a lower portion which during use is submerged, said housing further including a rearwardly projecting generally horizontally elongated intermediate portion including a generally horizontal cavitation plate, a propeller supported by said lower portion below said cavitation plate;

a laterally extending vertical trim correction vane member;

support strut means depending from a rear part of the horizontally elongated intermediate portion of said housing, said support means mounting said vane member onto said housing and positioning said vane at a location below the water line, aft of the propeller and substantially withing the slipstream of the propeller;

pivot means mounting said vane member onto said support strut means for rotation about an axis extending transversely of the axis of rotation of the propeller; and means for rotating said vane in position about said axis, to change the angle of attack of said vane member.

11. The combination of claim 10, comprising an upstanding control lever connected with said vane member, for rotating said vane member about said transverse axis, push-pull control cable means which in use is connected at its rear end to a top portion of said upstanding control lever and extends forwardly therefrom to an operators station, and support means for said push-pull control cable means carried by the intermediate portion of said housing.

* * * * *